US009179756B2

(12) United States Patent
Weinberg

(10) Patent No.: US 9,179,756 B2
(45) Date of Patent: Nov. 10, 2015

(54) LIQUID CARRYING CASE FOR TRAVEL

(71) Applicant: Francine Weinberg, New York, NY (US)

(72) Inventor: Francine Weinberg, New York, NY (US)

( * ) Notice: Subject to any disclaimer, the term of this patent is extended or adjusted under 35 U.S.C. 154(b) by 0 days.

(21) Appl. No.: 14/216,651

(22) Filed: Mar. 17, 2014

(65) Prior Publication Data

US 2014/0262867 A1 Sep. 18, 2014

Related U.S. Application Data

(60) Provisional application No. 61/788,657, filed on Mar. 15, 2013.

(51) Int. Cl.

| | |
|---|---|
| ***A45D 40/22*** | (2006.01) |
| ***A45D 34/00*** | (2006.01) |
| ***A45C 11/00*** | (2006.01) |
| ***A45C 13/02*** | (2006.01) |

(52) U.S. Cl.

CPC ..... *A45D 40/221* (2013.01); *A45C 11/00* (2013.01); *A45C 11/008* (2013.01); *A45C 13/02* (2013.01); *A45D 34/00* (2013.01); *A45D 2040/223* (2013.01)

(58) Field of Classification Search

CPC . A45C 5/005; A45C 5/03–5/04; A45C 11/00; A45C 11/20; A45C 13/02; A45C 2013/026; A47J 47/14; B65D 51/246; B65D 81/113; B65D 85/324

USPC ..... 206/341, 461, 464–465, 471, 472, 206/546–547, 563–564, 597; 220/500, 220/DIG. 26; 190/100, 109–111

See application file for complete search history.

(56) References Cited

U.S. PATENT DOCUMENTS

| | | | | | |
|---|---|---|---|---|---|
| 2,343,763 | A | * | 3/1944 | Fridolph | 312/306 |
| 2,496,296 | A | * | 2/1950 | Lobl | 62/329 |
| 2,584,435 | A | * | 2/1952 | Doerr | 165/58 |
| 3,732,955 | A | * | 5/1973 | Carter et al. | 190/109 |
| 4,106,597 | A | * | 8/1978 | Shook et al. | 190/110 |
| 4,303,610 | A | * | 12/1981 | Sardisco et al. | 422/430 |
| 4,350,274 | A | * | 9/1982 | Morgan | 206/223 |
| 4,446,705 | A | * | 5/1984 | Loucks | 62/372 |
| 4,638,909 | A | * | 1/1987 | Ford | 206/1.7 |

(Continued)

OTHER PUBLICATIONS

International Search Report for PCT/US2014/30674, mailed on Aug. 13, 2014.

*Primary Examiner* — Bryon Gehman
*Assistant Examiner* — Brijesh V. Patel
(74) *Attorney, Agent, or Firm* — Chris Pilling

(57) ABSTRACT

The present disclosure relates to a travel kit which includes a carrying case including a bottom portion and a top portion. The top portion connects to the bottom portion via a fastening means. The kit includes a plurality of containers for the carrying and storage of liquid and similar substances. The containers include a lid with a locking mechanism. The case includes a plurality of securing means attached to the interior wall of the top portion of the carrying case which corresponds to the shape of the plurality of containers and receives the plurality of containers. The case includes a plurality of raised edges attached to the interior bottom wall of the bottom portion of the carrying case. The plurality of raised edges correspond to the shape of the plurality of containers and receives the plurality of containers. The kit includes an instrument for transferring liquid or similar substances into the plurality of containers which is secured to the interior of the carrying case.

16 Claims, 10 Drawing Sheets

Perspective view of the carrying case with containers and spatula

(56) References Cited

U.S. PATENT DOCUMENTS

| | | | | | |
|---|---|---|---|---|---|
| 4,746,008 | A * | 5/1988 | Heverly | B65D 55/02 | 206/1.5 |
| 4,929,948 | A * | 5/1990 | Holmberg | 206/320 | |
| 5,024,067 | A | 6/1991 | Maier, II | | |
| 5,082,115 | A | 1/1992 | Hutcheson | | |
| 5,111,919 | A | 5/1992 | Hamatani et al. | | |
| D336,849 | S * | 6/1993 | Golias | D3/203.1 | |
| 5,265,719 | A * | 11/1993 | Wand | 206/223 | |
| 5,291,997 | A * | 3/1994 | He et al. | 206/370 | |
| 5,579,914 | A | 12/1996 | Thore | | |
| 5,671,846 | A * | 9/1997 | Frank | 206/541 | |
| 5,785,179 | A * | 7/1998 | Buczwinski | B65D 43/16 | 206/1.5 |
| 6,214,063 | B1 * | 4/2001 | DeStefano et al. | 44/275 | |
| 6,267,078 | B1 * | 7/2001 | Pina | 119/165 | |
| 6,832,686 | B2 * | 12/2004 | Donegan | B65D 77/02 | 206/1.5 |
| 7,331,461 | B2 | 2/2008 | MacKinnon | | |
| 7,607,540 | B2 | 10/2009 | Ballard | | |
| 7,861,552 | B1 * | 1/2011 | Hughes | 62/457.2 | |
| D647,211 | S * | 10/2011 | Belfance | D24/224 | |
| 2005/0109776 | A1 * | 5/2005 | Camp | 220/23.86 | |
| 2006/0108240 | A1 * | 5/2006 | MacKinnon | 206/223 | |
| 2009/0078607 | A1 * | 3/2009 | Ballard | 206/541 | |
| 2009/0095699 | A1 * | 4/2009 | Milante | A61J 1/03 | 215/217 |
| 2009/0294310 | A1 * | 12/2009 | Franczyk et al. | 206/229 | |
| 2010/0294767 | A1 * | 11/2010 | Catteau et al. | 220/231 | |
| 2011/0000930 | A1 * | 1/2011 | Logel | B65D 43/162 | 220/849 |
| 2013/0081364 | A1 * | 4/2013 | Piscopo | 53/492 | |

* cited by examiner

Perspective view of the carrying case and locking mechanism

Perspective view of the carrying case with containers and spatula

Alternative perspective view of the carrying case with top lid showing the bumpers and mirror Perspective view of the bottom lid of the carrying case showing the securing ridges Perspective view of an individual container in a closed position

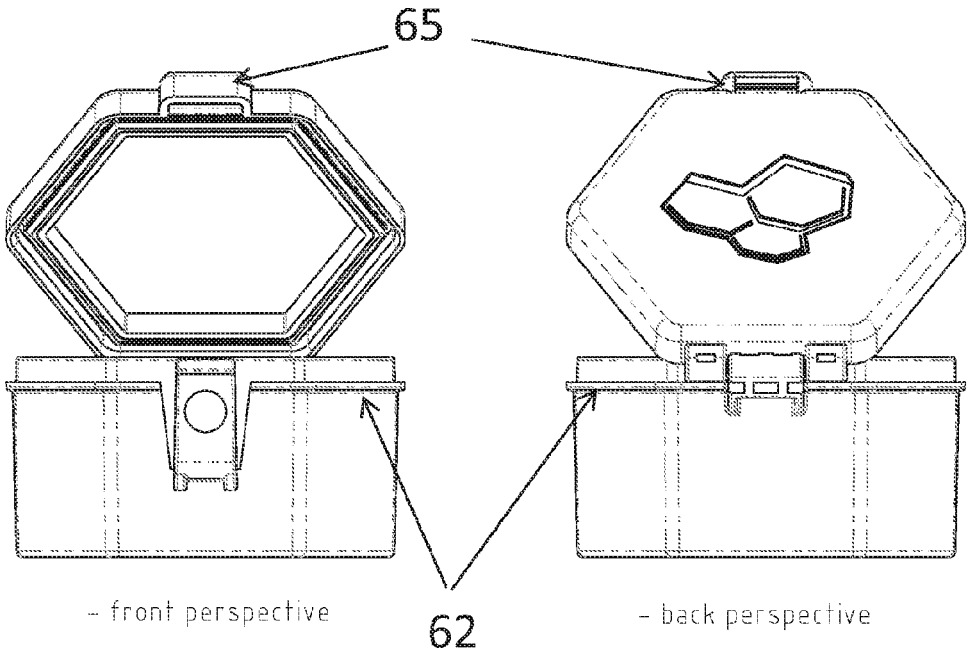
Figure 6
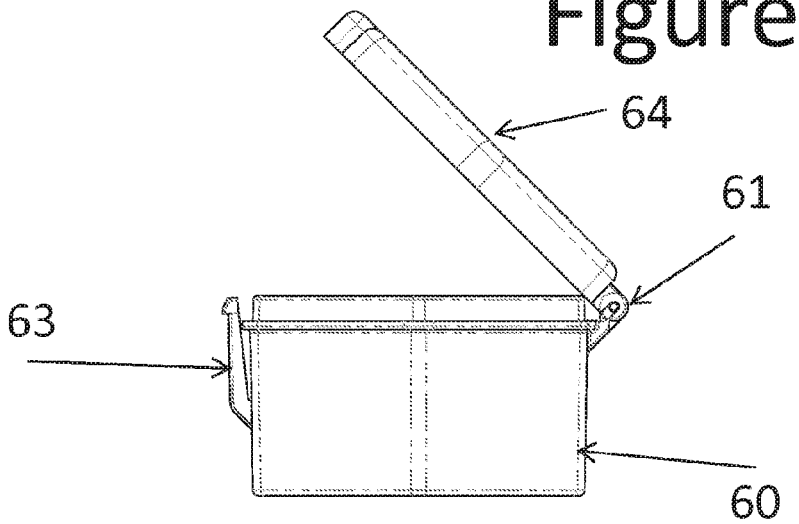
- side perspective
Perspective view of an individual container in an open position

- large container

- small container

Top down perspective

- large container

- small container

Front perspective

- large container

- small container

Back perspective

- large container

- small container

Side perspective

Perspective view of the large and small individual containers

Perspective view cross section of the individual container showing the locking mechanism, hinge and gasket Perspective view of the spatula

- front perspective

- section view

- side perspective

Perspective views of the internal gasket of the individual container

LIQUID CARRYING CASE FOR TRAVEL

CROSS-REFERENCE TO RELATED APPLICATION

This application claims priority to U.S. Provisional Patent Application 61/788,657, filed on Mar. 15, 2013, the disclosure of which is incorporated herein by reference in its entirety for any purpose whatsoever.

BACKGROUND

1. Field

The present application relates to a travel carrying case for liquid based products used in personal care.

2. Description of Related Art

In August 2006, the Transportation Security Administration (hereinafter TSA) enacted the "311" rules that stipulate any liquids passing through security checkpoints must be only for personal use, and must be placed in containers of 3.4 ounce or less, and all containers must fit into a 1 quart (QT) bag. The TSA 311 rule=3 ounces (oz.) liquid, 1 QT plastic baggie, per 1 person.

The TSA's focus has been, and will continue to remain, squarely on managing liquid carry-ons to find explosive weapons, such as those that are carried in ordinary skin cream jars and in liquids containers. For this reason, it is not expected that the TSA will loosen the restrictions on the liquid 311 rules in the near future. In addition, large consumer brands in the personal product space spend millions on developing and enhancing brand loyalty to their products, but they rarely manufacture their products in small convenient travel sizes.

Current inexpensively made travel tubes are hard to fill, difficult to clean, and usually not meant to store liquid products contents over long periods. If the traveler has liquid product left over in the container after the trip, the unused lotion may have to be discarded, thus wasting valuable and expensive skin-care products. Additionally, these travel bottles and tubes may not be watertight sealed and may leak into travel bags. Moreover, other travel tubes and bottles containers currently available are sometimes made from unidentified types of plastics (unless there is a recycling symbol on the bottom) and are made, look and feel inexpensive and are usually not dishwasher safe. The present application provides improvements over the state of the art as described herein.

SUMMARY OF THE DISCLOSED EMBODIMENTS

Advantages of the present disclosure will be set forth in and become apparent from the description that follows. Additional advantages of the disclosure will be realized and attained by the methods and systems particularly pointed out in the written description and claims hereof, as well as from the appended drawings.

The present disclosure relates to a travel kit which includes a carrying case having a bottom portion and a top portion. The top portion connects to the bottom portion via a suitable fastener. The kit includes a plurality of containers for the carrying and storage of liquid and similar substances. The containers include a lid with a locking mechanism. The case includes a plurality of securing connectors attached to the interior wall of the top portion of the carrying case which corresponds to the shape of the plurality of containers and receives the plurality of containers. The case includes a plurality of raised edges attached to the interior bottom wall of the bottom portion of the carrying case. The plurality of raised edges correspond to the shape of the plurality of containers and receives the plurality of containers. The kit includes an instrument for transferring liquid or similar substances into the plurality of containers which is secured to the interior of the carrying case.

The present disclosure relates to a container for holding liquids which includes an upper portion with a top lid with an interior perimeter fitted gasket and a bottom portion with a hollow interior compartment for receiving liquids and similar substances. The bottom portion includes a perimeter for receiving the interior fitted gasket. The container includes a fastening means affixed to the external wall of the bottom portion and a hinge attached to the bottom portion and top lid. The upper portion of the container is sealed to the bottom portion through the interior fitted gasket and further secured by the fastener.

In some implementations, the present application's liquid carrying travel case meets the burden placed on airline travelers by allowing a traveler to pass through TSA security screening checkpoints and travel on the airplane with multiple containers of 3 ounces (oz.) or less of personal liquids, such as shampoo, hair conditioners, skin creams, liquid cosmetics, etc. in compliance with the TSA 311 rules.

The liquid carrying case of the present application benefits a more affluent traveler that is more conscious of and concerned with their appearance, health and status. Such a traveler typically uses more expensive personal liquid products, yet still is cost conscious and unlikely to purchase expensive skin creams when traveling to avoid the TSA rules or checking bags. The target market consumer would rather have some way to bring these expensive products with them in small quantities.

The liquid carrying case is not limited to air travel. The liquid traveling case is used in many other traveling situations where personal liquids (i.e. skin and hair liquid products) may be carried for personal consumption in watertight containers.

Illustrative embodiments of the liquid carrying case includes plastic Tritan® material (a type of branded engineering polymer co-polyester plastic from Eastman Chemical Company (Kingsport, Tenn.)) containers which are water-clear, highly durable, chemical and heat resistant while being dishwasher safe, food-grade and BPA-free. The liquid container design is open at the top and the containers are durable and sturdy enough to allow a user to efficiently and completely wash it out using nothing more than ordinary dishwasher detergent. Containers will be very easy to clean by hand or placed into a dishwasher.

If the containers are used for air travel, the cargo hold of any airplane is pressurized but very often unevenly temperature controlled. The cargo hold of the airplane and the airport tarmac in a colder location, could drop to or below freezing and if travel bags are left in those cold environments long enough, the bag's liquid contents could freeze as well, and through liquid freezing and the subsequent container expansion, would present a leaking hazard when the frozen liquids thaw out. The liquid carrying case of the present application solves this problem because the container design has a well built into the bottom of the container and at the top lid to accommodate a liquid freezing inside without breaking the gasket seal.

It is to be understood that the foregoing general description and the following detailed description are exemplary and are intended to provide further explanation of the disclosed embodiments. The accompanying drawings, which are incorporated in and constitute part of this specification, are included to illustrate and provide a further understanding of the disclosed methods and systems. Together with the description, the drawings serve to explain principles of the disclosure.

BRIEF DESCRIPTION OF THE FIGURES

FIG. 6 is a perspective view of an individual container in an open position.

DETAILED DESCRIPTION

Figure 1:
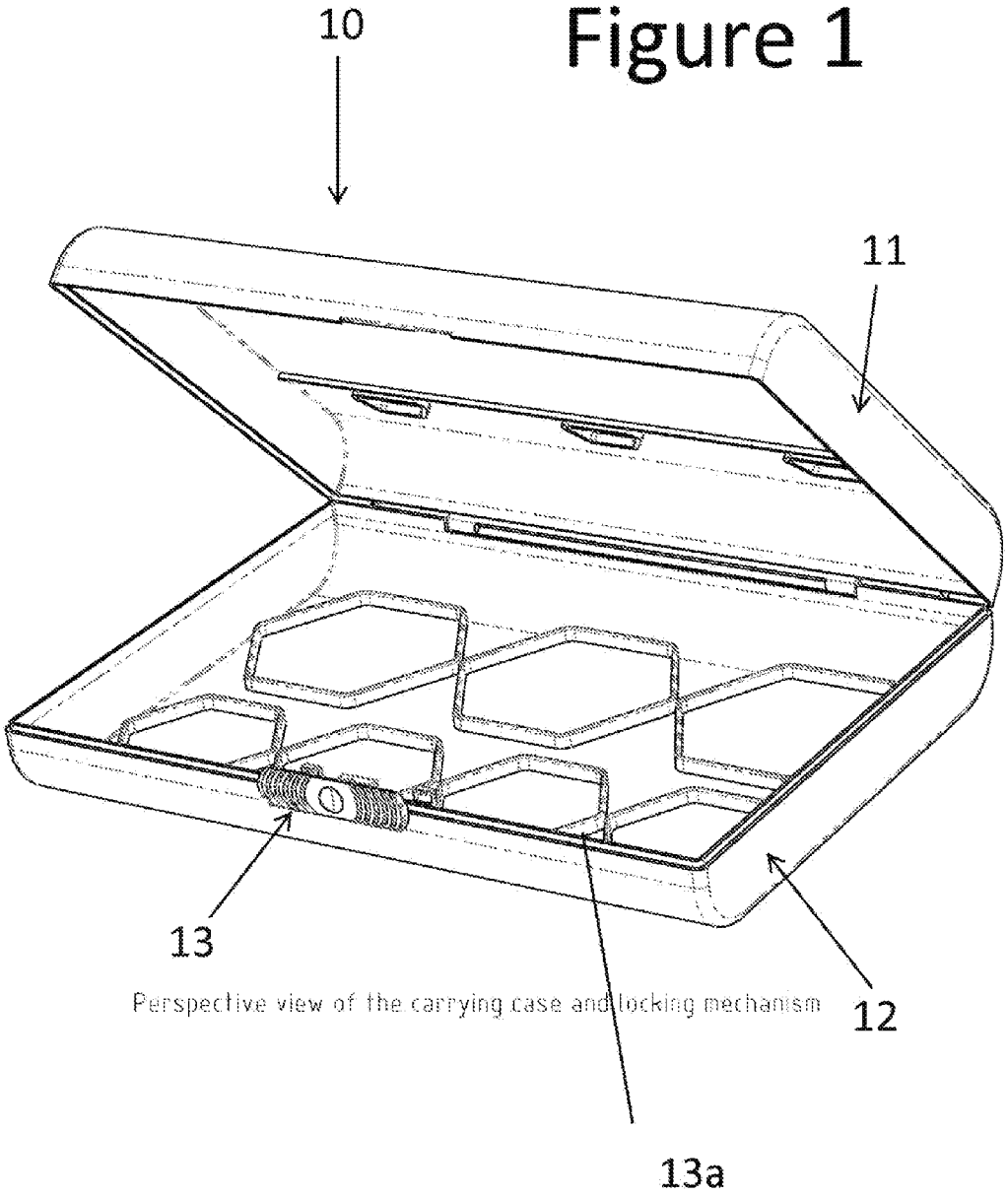
FIG. 1 is a perspective view of an exemplary carrying case and locking mechanism.

As shown in FIG. 1, an illustrative liquid carrying case to of the present application is a personal liquid carrying case designed to be a luxury travel goods product primarily targeted to female travelers. The purpose of the liquid carrying case is to allow a traveler to pass through TSA security screening checkpoints and travel on the airplane with 3 ounces (oz.) or less of personal liquids, such as shampoo, hair conditioners, skin creams, liquid cosmetics, etc. in compliance with the TSA 311 rules. The liquid travel case usage is not limited to airline travel and the case is used for other types of travel by car or elsewhere to carry hair and skin liquid products.

The liquid carrying case to includes an external shell case top lid 11 and shell case bottom lid 12 with a sliding latch 13 located on the bottom lid 12. The illustrated case 10 is rectangular and measures approximately 6 inches width by 8 inches length and 1.7" inches in height (6 W×8" L×1.7" H), but it will be appreciated that these dimensions are non-limiting examples. The internal surface of the top lid has an illustrative logo in raised embossing. In another embodiment, the carrying case can include a variety of shapes and sizes. In another embodiment, the case can be closed by a spring loaded sliding latches, pull up latches, buttons, levers or snaps.

Figure 2:
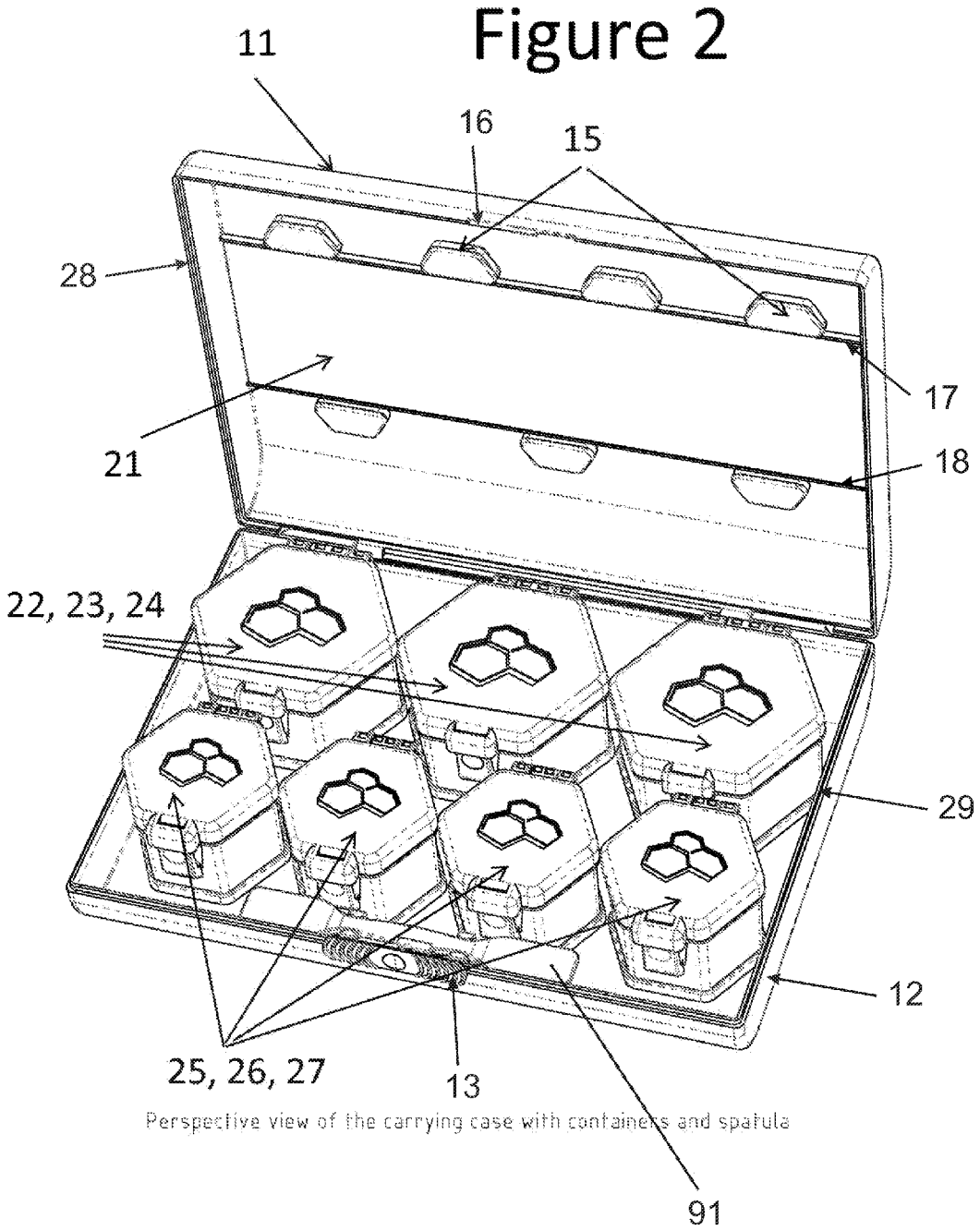
FIG. 2 is a perspective view of the carrying case with containers and spatula.
Figure 9:
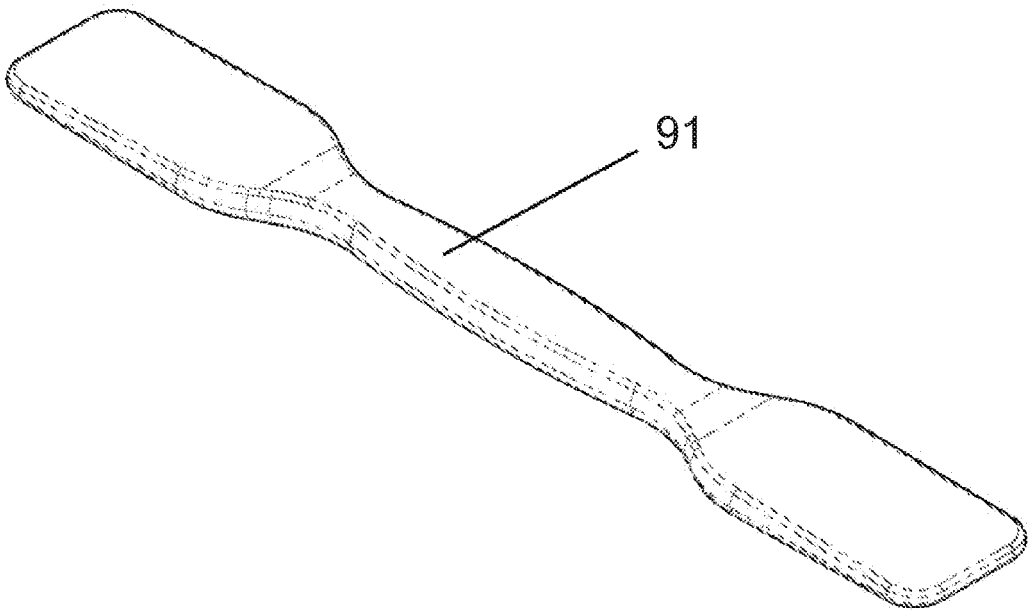
FIG. 9 is a perspective view of the spatula.

An example of a complete travel kit can be equipped with a mirror 21 affixed to the top lid 11 (as shown in FIG. 2), seven rubber bumpers 15 on the inside top lid 11 that secure the liquid containers, a separate spatula (as shown in FIG. 2 and in FIG. 9) that is used to transfer liquid products to the liquid containers, a protective nylon pouch cover (not shown) and an accompanying sheet of clear, white or colored adhesive labels for the containers (not shown).

As shown in FIG. 2, the carrying case can be fitted with seven internal containers—3 large (2 oz.) containers 22, 23, 24 and 4 (1 oz) small containers 25, 26, 27 that are shaped into hexagons. In another embodiment, the case can include other transferring instruments, such as a spoon or a plastic or wooden instrument. In another embodiment, the case can include more or less containers of varying sizes and shapes.

Figure 4:
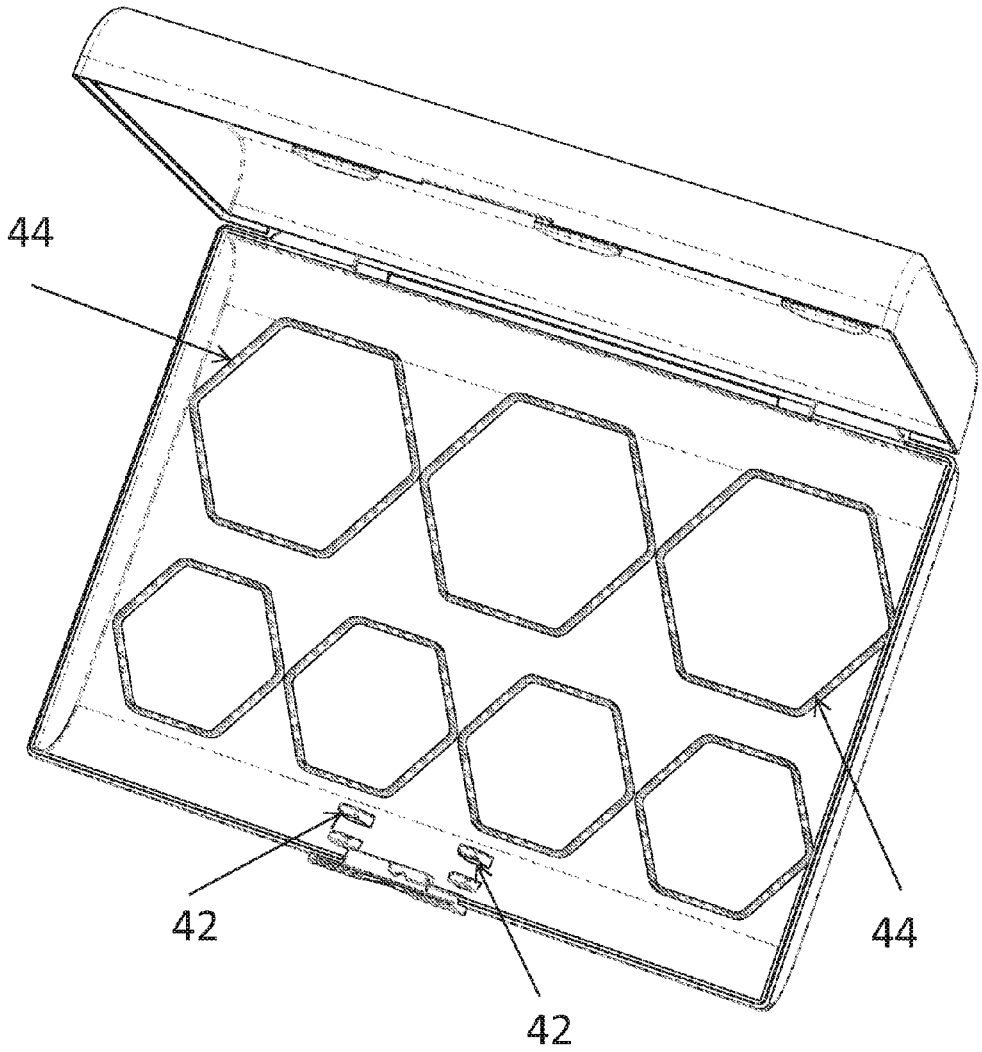
FIG. 4 is a perspective view of the bottom lid of the carrying case showing the securing ridges.

The seven liquid containers are positioned on the bottom lid in a horizontal array in two rows, including a top row and a bottom row. The 3 large containers are positioned in the top row and the 4 small containers are positioned in the bottom row. The seven liquid containers do not touch each other due to hexagonal raised edges 44 (FIG. 4). The hexagonal raised edges will be described in greater detail below.

In some embodiments, the top lid includes a first interlocking ridge 28, and the bottom lid includes a second interlocking ridge 29, wherein the first interlocking ridge and second interlocking ridge engage when the carrying case is in a closed position adding stability and preventing unwanted movement between the top and bottom lid. Sliding latch 13 is designed to lock into a locking portion 16 located on the first interlocking ridge. The locking portion is located in the same lateral position on the carrying case as the sliding latch. The sliding latch slides from left to right engaging the locking portion to lock the case as well known in the art.

Still referring to FIG. 2, the seven rubber bumpers are positioned on the inner section of the top lid 11 bordering the top and bottom surfaces of mirror 21. The seven rubber bumpers are designed to secure the seven internal containers in place. The mirror is made from an acrylic material and is positioned in the center of the inner section of the top lid. A top lip 17 and bottom lip 18 help position the mirror on the inner section of the top lid. The seven rubber bumpers have a height profile that is greater than the height profile of the mirror such that, when the carrying case is in a closed position, the bumpers are compressed against the internal containers preventing the containers from contacting and damaging the mirror.

Figure 3:
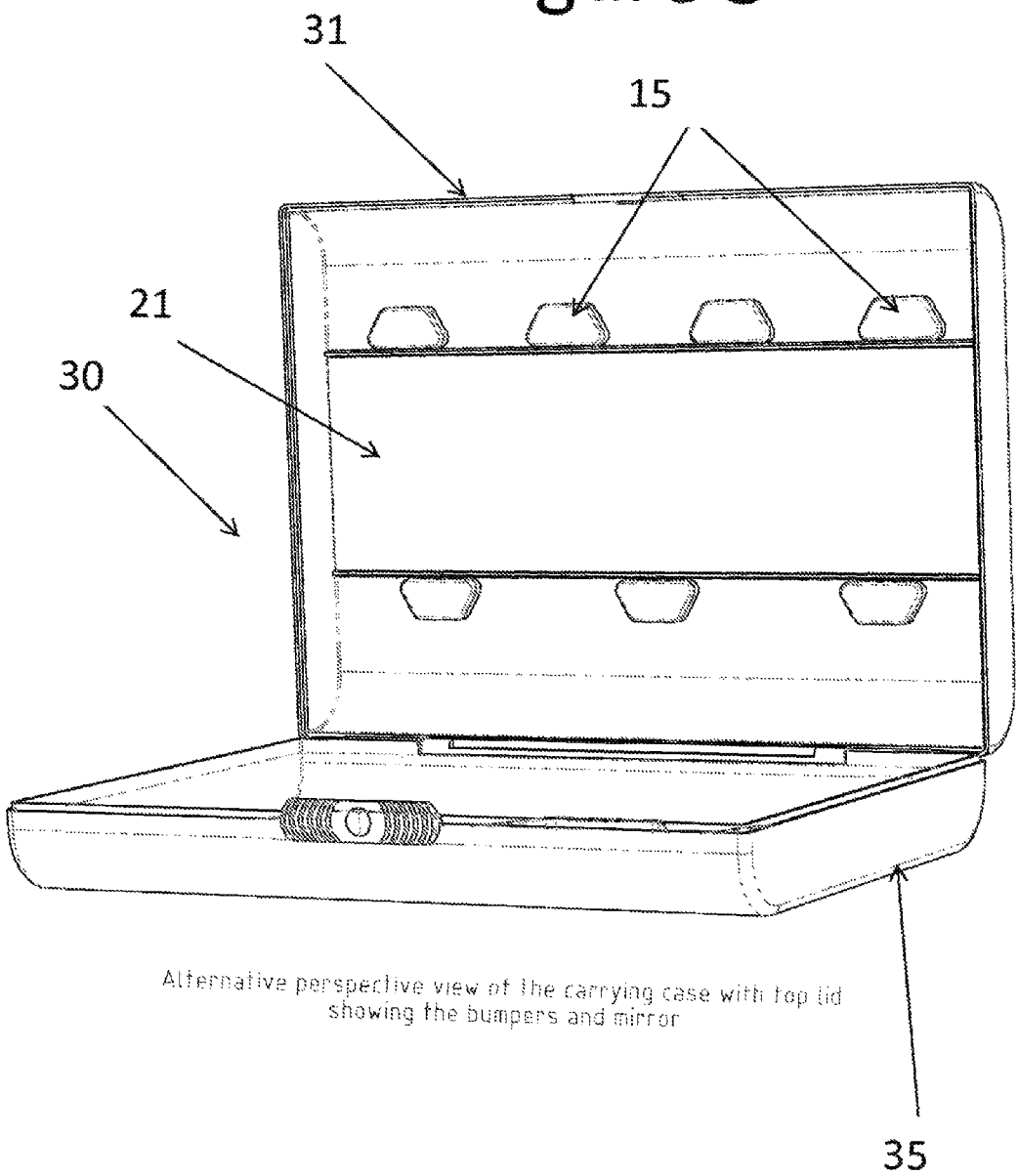
FIG. 3 is an alternative perspective view of the carrying case with top lid showing the bumpers and mirror.

The liquid products are placed into the liquid containers and not within the outer external case. As shown in FIG. 3, the top lid 31 of the external case 30 has a mirror attached 32, and seven (e.g., rubber) bumpers 15 to hold the containers in place and a spatula 91 (as shown in FIG. 2) that is secured inside the case. In another embodiment, the outer case can be made from either a co-polyester plastic or ABS. The bottom lid of the case 35 can have radius bumps (not shown) for feet to keep the case from sitting directly on a table. The bumps can have an average diameter of ¼", for example, or any other suitable dimension. In another embodiment, indented discs can be added to the outer case hinge to allow for the top lid to be adjusted into a plurality (2, 3, 4 . . . ) different position. In another embodiment, the outer case can contain a spring for the latch so that when the top lid is closed against the bottom lid, the spring loaded latch seals the top lid to the bottom lid. In another embodiment, the thickness of the top lid of the individual container can be increased by 0.030" so it does not warp under pressure. This will enhance the container top lid's stability when closed.

In another embodiment, the sides of the outer case, where the top and bottom lids meet, can be longer to further stabilize the case when sealed. In a further embodiment, the carrying case can be imprinted with designs utilizing a hydrographic printing process. The designs are preferably disposed only on the outside of the case.

In another embodiment, the outer case can be square or box shaped and has less curvature in the front. In this embodiment, a flatter (instead of curved front design) outer case design is equipped with a pull-up spring loaded clasp instead of a sliding latch. The pull-up clasp can be attached to prongs on the bottom lid. In another embodiment, the clasp can be metal and may be adorned with decorations. In another embodiment, the bottom lid of the container can include a secondary insert affixed to the interior bottom of the case that would have hexagonal holes corresponding to the size of the liquid containers and designed to hold the liquid containers. This insert can replace the rubber bumpers in the lid to secure the containers during transit.

As shown in FIG. 4, the spatula holder 42 can be on the bottom lid and have two sets (4 in total) of prongs protruding from the bottom with ridges to secure the spatula. The spatula can snap into the prong ridges flat horizontally on the bottom of the case. In another embodiment, the prong ridges can be on the top lid such that the spatula is held vertically instead of flat horizontally. In another embodiment, the spatula can slide into the ridge prongs vertically. Yet in another embodiment, the prong ridges can be on the top lid such that the spatula is held horizontally by the prong ridges.

Illustrated are two sizes of internal containers large (2 oz.) and small (1 oz.), wherein both are shaped into a hexagonal external shape. The carrying case can be configured to accommodate different sizes and shapes of containers. In such cases, the corresponding bumpers on the inside of the top portion of the case can be designed to receive and secure the various shaped and sized containers. The case can be equipped with 3 large containers each measuring approximately 2.6" width by 1.5" height with a 2 fluid ounce capacity and 4 small containers each measuring approximately 1.9" width by 1.5" height with a 1 fluid ounce capacity.

As shown in FIG. 4, each container can be secured on the bottom of the outer case by placing the container into a hexagonal raised edge 44 that lines the interior of the case's bottom and follow the hexagonal shape of each of the containers. Each individual container can be removable from the raised edges in the bottom of the external shell case. In another embodiment, the hexagonal ridges may contain vertical guides on each side of the ridge of about ⅜ or ½" tall that guide the liquid containers into the hexagonal pocket. These vertical guides protrude out from each side of the hexagonal pockets.

The hexagonal raised edges work in conjunction with the rubber bumpers (FIG. 3) to secure the internal containers in place when the top lid is closed. It shall be understood, that the internal containers are not attached to the bottom lid, however they are secured in place by the combination of the rubber bumpers and hexagonal raised edges.

Figure 5:
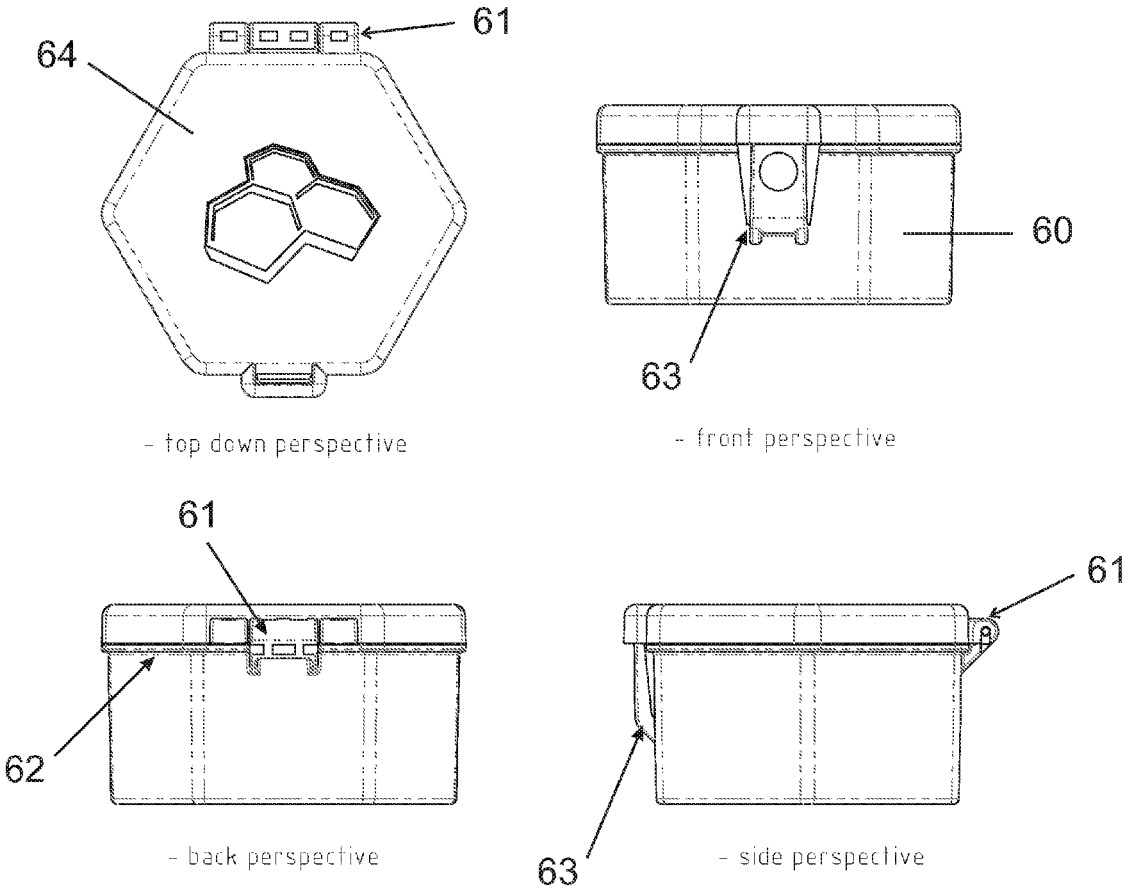
FIG. 5 is a perspective view of an individual container in a closed position.
Figure 7:
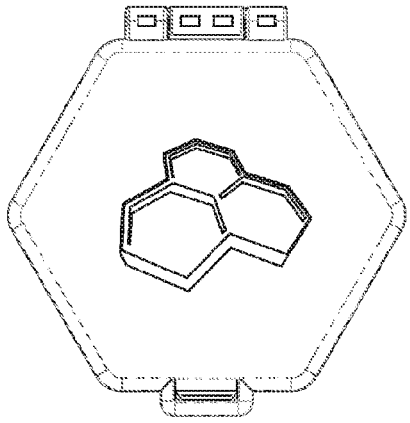
FIG. 7 is a perspective view of the large and small individual containers.
Figure 7:
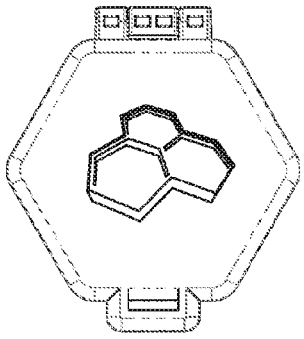
Figure 7:
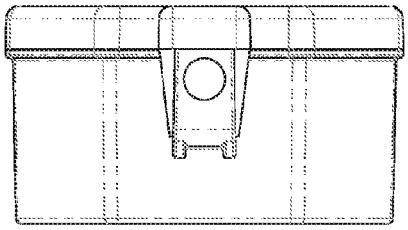
Figure 7:
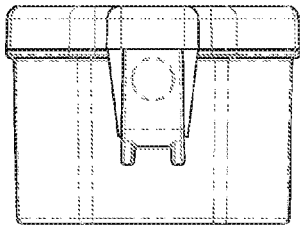
Figure 7:
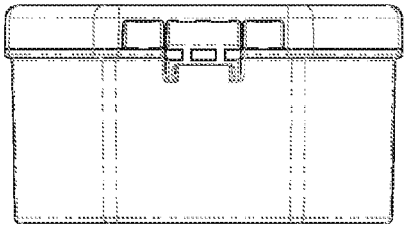
Figure 7:
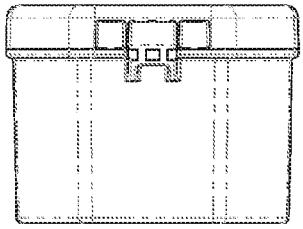
Figure 7:
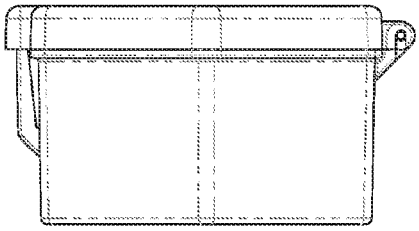
Figure 7:
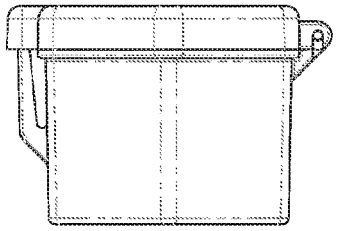
Figure 8:
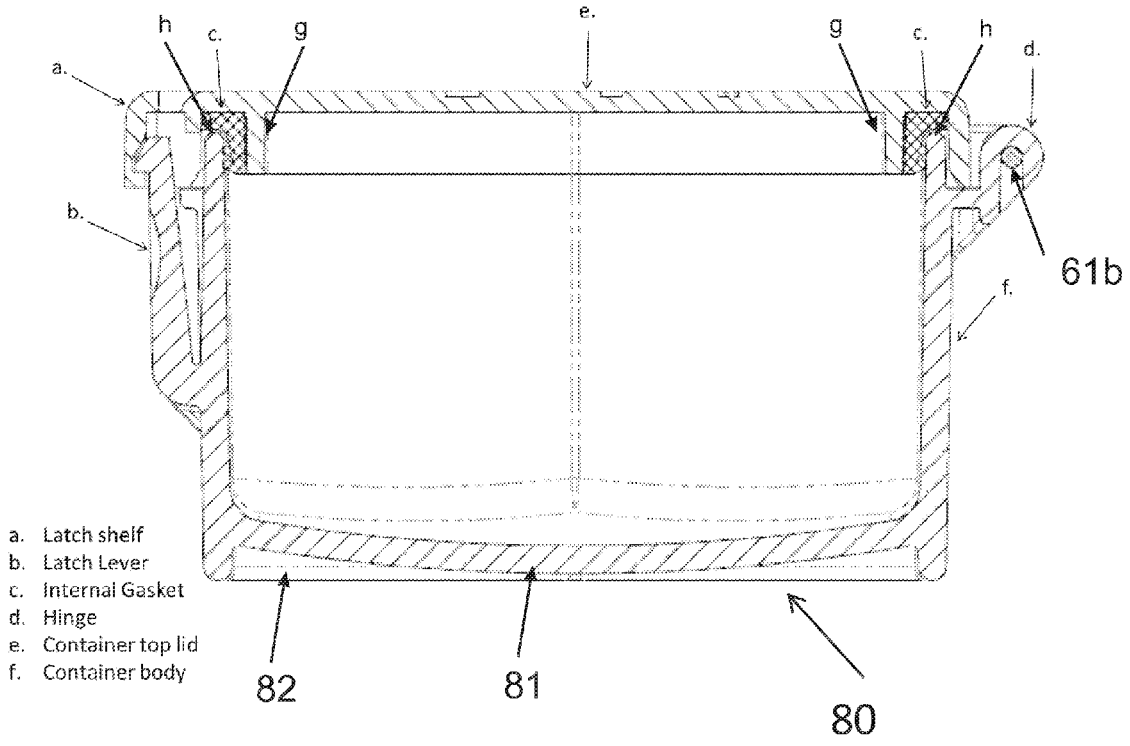
FIG. 8 is a perspective cross sectional view of the individual container.
Figure 10:
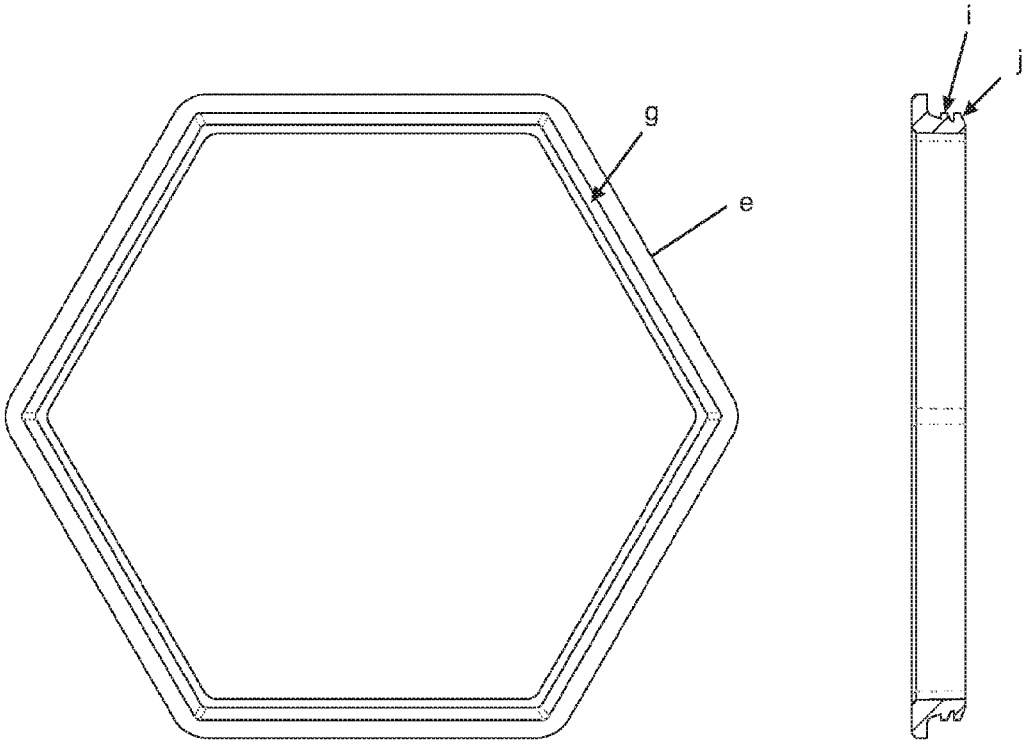
FIG. 10 is the perspective views of the internal gasket of the individual container.
Figure 10:
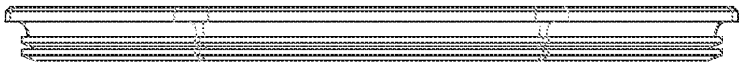

FIG. 5 shows perspective views of illustrative individual closed containers. FIG. 6 shows perspective views of the individual containers in an opened position. FIG. 7 shows the perspective views in relation to the differences in size between the large container and the small container. Each internal container is preferably sealable and watertight when closed to prevent the personal liquids from leaking out during travel. The lid on each container can be fitted with a hexagonal gasket to ensure watertight sealing. FIG. 8 shows the gasket locking mechanism of the containers. FIG. 10 shows a front and side perspective view of the gasket. The gasket may be made from silicone, polyurethane, or polyethylene, for example. The containers are preferably made out of a food-grade, free of bisphenolA (BPA), high clarity, highly durable, and dishwasher-safe type of plastic called Tritan® (a branded type of copolyester) made by Eastman Chemical Company. In another embodiment, the gasket may be larger on the outside and larger on the inside.

The hinge/latch design of the internal containers is a useful design that prevents the containers from popping open unexpectedly during transit and requires a secondary manual motion in order to open the lid. As shown in FIG. 6, the hinge 61 is raised and there are reinforcing support ridges 62 that extend to the container body 60 that reinforce the hinge. In another embodiment, the indent on the liquid container latch lever is convex instead of concave so it is easier to open.

As shown in FIG. 6, In a preferred embodiment, the liquid containers are sealed and secured with a flexible external latch lever 63 that extends down the front of the container body 60. When the latch lever 63 is sealed it catches into a latch shelf 65 which is a molded undercut built into the container top lid 64. The external latch lever 63 on each container body 60 is a separate plastic strip extending the length of the front of the container. In order to open the containers, the top front external latch lever 63 is pressed inwards, which releases it from the undercut latch shelf 65 built into the top lid 64. The top lid 64 is manually pulled up to open the container. When the container is sealed, the latch lever 63 is secured to the top lid 64 by the molded undercut latch shelf 65.

A particularly inventive feature of the present invention is that the latch level is positioned on the outer surface of the container body, allowing the container top lid to remain in an uncompressed state when opening and closing the top lid. In previous container configurations, a top lid would have to be compressed to open the container, which may affect the seal of the container over time. The present invention's configuration avoids potential stress that might affect the life the container and particularly the seal, allowing the container to provide a watertight seal throughout the useable life of the container.

The design of the container's lids are preferred for preventing the lids from being jostled open when the liquid carrying case is inserted into a checked travel bag. The hinge/latch design also prevents the lid from being accidently popped open if liquid contents freeze inside the container when placed into the airplane's cargo hold or left on the tarmac in a cold temperature environment during airplane transfers.

In another embodiment, the latch can be extended lower down the container by a small distance (e.g., ¼"). In another embodiment, a small bead (e.g., ⅙") can be located around the container lid on rim of the lid. The bead can be to assist a traveler in prying the container lid open. In another embodiment, the ridge surrounding the container is not included on the front of the container but the ridge is included on all other sides around the perimeter of the container.

As described above, FIG. 8 shows a cross sectional view of an individual container. The container 80 includes a latch shelf (a), latch lever (b), internal gasket (c), hinge (d), container top lid (e), container body (f), and inside ridge (g). As described above the latch lever fits into the latch shelf to secure the container top lid to the container body. The hinge connects the top lid and the container body and further controls the opening and closing of the top lid. The internal gasket fits along the inside of the container top lid, and is held in place by the inside ridge by tension force. The inside ridge protrudes perpendicularly from the inside surface of the container top lid, and is positioned approximately 3 mm from container body. Further, the internal gasket is an inverted "L" shape providing two sealing locations, specifically positioned vertically along the inside wall of the container body and the inside ridge, and positioned horizontally flat against the inside surface of the container top lid and a top surface (h) of the container body. When the container top lid is in a closed position (as illustrated), the internal gasket seals the container by means of a compression force of the container top lid against the top surface of the container body, and from the inside surface of the inside ridge against the inside wall of the container body. The internal gasket further comprises a first protruding finger (i; FIG. 10) and a second protruding finger (j; FIG. 10). The first and second protruding fingers provide additional sealing by gripping the inside wall of the container body. The internal gasket and protruding fingers are further shown and illustrated in FIG. 10.

As mentioned previously a well 82 is built into the bottom of the container to accommodate changes in pressure and allows bottom surface 81 to expand should liquids freeze in the container.

Still referring to FIG. 8, the container top lid is attached to the container body by hinge (d). The hinge is constructed from two portions, the first portion is attached to the container top lid and the second portion is attached to the container body. The first and second portions are secured together via a pin 61*b* extending through the first and second portions of the hinge. The latch level positioned in the front of the container adds pressure and works in conjunction with the force of the hinge to seal the container via the latch shelf and internal gasket.

The cargo hold of any airplane is pressurized but may have uneven temperature control unless there are animals, plants or other temperature sensitive cargo on board. The cargo hold of the airplane, and certainly the airport tarmac in a colder location, can drop far below the freezing point of water, and if travel bags are left in those environments long enough, the bag's liquid contents can freeze as well. The present disclosed embodiments are preferably configured to withstand the pressure changes that occur in a passenger cabin when an airplane takes off and lands.

An airplane will typically normalize its pressure at 8000 ft. (10.9 psia) when ascending into the air. To simulate those conditions, exemplary containers made in accordance with the teachings herein underwent testing in a polycarbonate tank with a vacuum transducer in order to simulate the change in pressure from sea level at 14.7 psia to 8000 ft 10.9 psia that is a pressure decrease of 3.8 psi (7.74 Hg), 1 inch of Mercury (Hg)=0.4911541 psia. The containers were filled about ⅔ full of water and then placed upside down on absorbent paper in the vacuum chamber. The pressure was then decreased inside the chamber to −8 Hg for 30 seconds. The test revealed that no water escaped the container nor did water visually appear on the absorbent paper.

The front external latch lever configuration of the containers has been designed to withstand the expansion pressure caused by freezing liquids. Water is known to expand by about 9% upon freezing and since many personal liquids—particularly shampoos and hair conditioners have a high content percentage of water, they can freeze as well given cold enough temperatures. The external front latch lever configuration prevents the accidental opening of the lid during travels and also adds extra protection against the containers opening when liquids freeze inside.

As a secondary precaution, the containers can also be designed with space for expansion at their bottom and top lids in case the liquids inside may freeze and expand. In the event the liquids do freeze inside the containers, since the external front clasp latch requires a manual effort to open, the lid cannot just pop open as long as the container is not overfilled. It is recommended that containers should be filled no more than the bottom lip of the container's lid.

The liquid carrying case is intended to carry personal liquids onto an airplane but is also used for travel anywhere personal liquids need to be taken, for example in a car or to the gym. The illustrated configuration of three large containers and four small containers can be particularly advantageous, based on the types of personal liquids and amounts of each liquid a traveler used during a trip. For example, the three large containers can hold liquids required in larger amounts like shampoo, conditioner and sunscreen lotions. The four small containers can hold liquids used in smaller amounts like liquid cosmetic foundation, and a variety of different skin creams like day cream, night cream, eye creams, etc.

Since each container fluid volume capacity is fairly small, the liquid carrying case product is designed for a frequent traveler who may want to carry a variety of personal liquids in small amounts for short trips. The liquid carrying case is used for both the personal and business traveler.

All types of travelers, including those who travel for personal purposes as well as business, may also want to use the liquid carrying case if they have at some point in their past travels, had a lot of personal products confiscated at the TSA security checkpoints for non-compliance with the TSA 311 rules.

Another benefit of the containers is that, in some embodiments, they can be made from a specially designed plastic called Tritan® plastic, which is a copolyester resin and not a polycarbonate (which contains BPA). The Tritan® plastic does not contain BPA and therefore will not leach BPA (a harmful chemical) into the skin or hair liquid products. The liquid containers can be made from an FDA food-grade rated version of Tritan® copolyester plastic resin. Since this chemical leaching will not occur, and the plastic used is food-grade, the internal compartment containers can also be used for long-term storage of any unused liquid products—i.e. skin-care lotions-remaining at the end of trip. Thus, expensive skin creams and the like will not be wasted by having to discard them when the trip is over.

The liquid carrying case is useful for the frequent traveler who is a loyal consumer of commercial skin-care lotions and creams, shaving creams, makeup and other liquid personal products. Large consumer brands in the personal product space spend millions of dollars on developing and enhancing brand loyalty to their products, but they rarely manufacture their products in small convenient travel sizes. Many of the commercially available brand skin care product sizes are over 3 oz., or if they are under 3 oz, the jar is often large and bulky and won't fit into a 1 QT size plastic bag as required by the TSA. Because of the size constraints for traveler's favorite products, many business airline travelers are forced to place their favorite skin creams into checked suitcases that otherwise may be more conveniently carried onto the plane.

Alternatively, for the frequent airline travelers who cannot or will not check their bags, they usually won't be able to use their favorite liquid products. These travelers are forced to buy other skin care products, often of inferior quality, or travel sized skin-care products available at pharmacies for their carry-on bags. Applicant intends that the product shall be sold and marketed under the name Airsafe Carryon™.

Various other components may be included and called upon for providing for aspects of the teachings herein. For example, additional materials, combinations of materials and/or omission of materials may be used to provide for added embodiments that are within the scope of the teachings herein. In the present application a variety of variables are described, including but not limited to components and conditions. It is to be understood that any combination of any of these variables can define an embodiment of the disclosure. Other combinations of articles, components, conditions, and/or methods can also be specifically selected from among variables listed herein to define other embodiments, as would be apparent to those of ordinary skill in the art.

When introducing elements of the present disclosure or the embodiment(s) thereof, the articles "a," "an," and "the" are intended to mean that there are one or more of the elements. Similarly, the adjective "another," when used to introduce an element, is intended to mean one or more elements. The terms "including" and "having" are intended to be inclusive such that there may be additional elements other than the listed elements.

While the disclosure refers to exemplary embodiments, it will be understood by those skilled in the art that various changes may be made and equivalents may be substituted for elements thereof without departing from the scope of the disclosure. In addition, many modifications will be appreciated by those skilled in the art to adapt a particular instrument, situation or material to the teachings of the disclosure without departing from the spirit thereof. Therefore, it is intended that the disclosure not be limited to the particular embodiments disclosed.

What is claimed is:

1. A travel kit comprising:

(a) a carrying case comprised of a bottom portion and a top portion; the top portion including a first interlocking ridge having a locking portion, the bottom portion including a second interlocking ridge and a fastener; wherein the first interlocking ridge and second interlocking ridge engage when the carrying case is in a closed position, and the fastener is adapted to engage the locking portion to secure the carrying case in the closed position;

(b) a plurality of containers for the carrying and storage of liquid and similar substances, each of the plurality of containers include a body and a lid with a locking mechanism; wherein the locking mechanism comprises an external latch lever positioned on an outer surface of the body and a latch shelf positioned on the lid;

(c) a plurality of connectors; the plurality of connectors comprised of rubber bumpers having a first height profile and attached to an interior wall of the top portion of the carrying case, wherein the rubber bumpers are a securing means corresponding to the shape of the plurality of containers and adapted and configured to receive the plurality of containers;

(d) a plurality of raised edges attached to an interior bottom wall of the bottom portion of the carrying case having a shape corresponding to the shape of the plurality of containers and adapted and configured to receive the plurality of containers; the plurality of raised edges are configured in a horizontal array;

(e) an instrument for transferring liquid into the plurality of containers, the instrument secured to an interior of the carrying case by a plurality of prong ridges providing a snap-fit connection.

2. The travel kit of claim 1, wherein the plurality of containers include varying sizes and shapes, and the plurality of containers correspond to the plurality of connectors.

3. The travel kit of claim 1, wherein the locking mechanism is located in an internal perimeter of the respective lid of the plurality of containers.

4. The travel kit of claim 1, wherein the plurality of containers are hexagonal and provided in two different capacities.

5. The travel kit of claim 1, wherein the top and bottom portions are made from plastic.

6. The travel kit of claim 1, wherein the instrument for transferring liquid is a spatula, and the plurality of prong ridges are positioned on the bottom portion or the top portion.

7. The travel kit of claim 1, further comprising a mirror, a top lip, and a bottom lip positioned on the interior wall of the top portion, the top lip and bottom lip extending parallel throughout the width of the interior wall of the to portion positioning the mirror to the center of the interior wall of the to portion, the mirror having a second height profile, wherein the second height profile is smaller than the first height profile such that: when the carrying case is in a closed position the rubber bumpers are compressed against the plurality of containers preventing the plurality of containers from contacting and damaging the mirror.

8. The travel kit of claim 1, wherein each of the plurality of containers further comprise a hinge and an internal gasket, the respective lid having an inside ridge protruding perpendicularly from an inside surface on the lid, and the body having a peripheral top surface.

9. The travel kit of claim 8, wherein the respective internal gasket has an inverted "L" shape having a a first surface engaging the inside surface of the respective lid on two dimensional surfaces: (a) the peripheral top surface which engages on a respective top lip of the respective body, and (b) a surface tension fit against the lid inside ridge of the respective lid that engages an internal surface wall of the respective body when the lid is closed, the two dimensional surfaces acting to seal each of the plurality of containers watertight.

10. The travel kit of claim 9, wherein the respective internal gasket is seated on the inside ridge by tension force, and the respective internal gasket seals each of the plurality of containers by compression force.

11. The travel kit of claim 9, wherein the respective internal gasket further comprises a first protruding finger and a second protruding finger, wherein the first and second protruding fingers provide additional sealing means by gripping the internal surface of the respective body.

12. A container, comprising:

a container body having an external surface and an internal surface, the internal surface having a peripheral top surface;

a container top lid having an interior surface, the interior surface including an inside ridge protruding perpendicularly;

a latch lever positioned on the external surface of the container body;

a latch shelf adapted and configured with a molded undercut built into the container top lid;

the latch shelf secured by the latch lever;

an internal gasket;

a hinge having a first portion and a second portion, the first portion attached to container top lid and the second portion attached to the external surface of the container body, wherein the first and second portions are secured together via a hinge pin, the hinge connecting the container body to the container top lid.

13. The container of claim 12, further comprising a well and an expandable bottom surface, wherein the expandable bottom surface may expand into the well.

14. The container of claim 12, wherein the internal gasket has an inverted "L" shape, such that: when the container is in a closed position, the internal gasket has a first surface engaging both the interior surface of the container top lid and the peripheral top surface of the container body, and a second surface engaging both the inside ridge and the internal surface of the container body sealing the container watertight.

15. The container of claim 14, wherein the internal gasket is seated on the inside ridge by tension force, and the internal gasket seals the container by compression force.

16. The container of claim 14, wherein the internal gasket further comprises a first protruding finger and a second protruding finger, wherein the first and second protruding fingers provide additional sealing means by gripping the internal surface of the container body.

* * * * *